United States Patent [19]

Watkins et al.

[11] Patent Number: 4,995,464

[45] Date of Patent: Feb. 26, 1991

[54] WELL APPARATUS AND METHOD

[75] Inventors: Bruce J. Watkins; Blake T. DeBerry, both of Houston, Tex.

[73] Assignee: Dril-Quip, Inc., Houston, Tex.

[21] Appl. No.: 398,716

[22] Filed: Aug. 25, 1989

[51] Int. Cl.[5] ..... F16L 27/12; E21B 33/035

[52] U.S. Cl. ..... 166/382; 166/344; 166/348; 166/117.7; 166/387; 285/39; 285/140

[58] Field of Search ..... 166/335, 341, 344, 345, 166/348, 350, 359, 382, 383, 387, 208, 240, 338, 339, 342, 378, 117.7, 119, 139, 238, 242, 330, 332, 115, 182, 191, 334; 285/39, 32, 31, 140, 133.2, 137.2, 141; 175/321, 322

[56] References Cited

U.S. PATENT DOCUMENTS

| | | | |
|---|---|---|---|
| 3,672,705 | 6/1972 | Rush | 285/39 |
| 4,239,083 | 12/1980 | Silberman et al. | 166/117.7 |
| 4,634,152 | 1/1987 | Pettit | 285/39 |
| 4,674,576 | 6/1987 | Goris et al. | 166/382 |
| 4,714,111 | 12/1987 | Brammer | 166/182 |
| 4,719,971 | 1/1988 | Owens | 166/191 |
| 4,757,860 | 7/1988 | Reimert | 166/208 |
| 4,823,871 | 4/1989 | McEver et al. | 166/182 |
| 4,836,288 | 6/1989 | Wester | 166/348 |

*Primary Examiner*—Stephen J. Novosad

*Attorney, Agent, or Firm*—Vaden, Eickenroht, Thompson & Boulware

[57] ABSTRACT

There is disclosed an offshore well installation wherein a shoulder of a casing hanger body supported within a casing head on a platform at the water surface has been lowered onto a seat in the head so as to support a casing string anchored at its lower end to a mudline hanger in tension, the lower end of the hanger body being connected to the upper end of the string by an adjustable sub which is manpulated by a tool lowered through the hanger body and into the sub so as to adjust it from an extended position in which its shoulder is above the seat in the head to a retracted position in which the shoulder is seated on the head and the casing string is placed in tension.

26 Claims, 6 Drawing Sheets

WELL APPARATUS AND METHOD

This invention relates generally to improvements in apparatus including subs for connecting well conduits in such a manner that they may be moved longitudinally with respect to one another. In one of its aspects, it relates to apparatus of this type which is useful in the drilling and/or completion of an offshore well wherein a pipe string anchored to a mudline hanger at the floor of the ocean is suspended in tension from a wellhead on a platform at the water surface. In another of its aspects, this invention relates to such apparatus which includes a tool useful in so adjusting the subs, particularly from a remote location, such as a platform at the water surface, without obstructing normal flow through the conduits. In still another of its aspects, it relates to a sub of this type which forms a sealed connection between the well conduits during use.

In certain types of offshore well installations, it is necessary to tie a casing string back from a mudline hanger anchored at the ocean floor to a wellhead mounted on a platform at the water surface. Since the distance between the mudline hanger and a seat in the wellhead on which a hanger at the upper end of the string is to be landed is fixed, it is necessary to adjust the effective vertical spacing between the hangers at opposite ends of the string in some way in order to suspend it in tension.

One possible solution is the use of short lengths of "pup" joints in the string, and another is to cut the casing string at the wellhead and suspend the cut end from slip type hangers, as is often done in the case of land type well completions. However, both of these procedures are time consuming and costly, especially at, offshore installations.

U.S. Pat. No. 4,794,988 discloses a hanger body which includes vertically adjustable parts, the upper of which is adapted to land on the seat in the head and the lower of which is connected to the upper end of the casing string. During installation, a shoulder on the upper part is initially above and then lowered onto the seat in order to support the string in tension. In addition to requiring a hanger body of complex and expensive construction, this requires that the wellhead be taller than would be necessary with a conventional installation.

The disposal of a straight threaded, longitudinally adjustable sub in the string beneath the hanger, which might otherwise seem a logical solution to avoid the use of such pup joints, slip type hangers or specially constructed hangers, is not practical because of the frequent need, during drilling and/or completion of the well and before landing of a hanger body in the head, to rotate the string in opposite directions. This may be required, for example, in order to open and close ports in the mudline hanger to which the lower end of the string is connected.

It is therefore an object of the invention to provide such apparatus, including a sub for use in connecting the lower end of a hanger body and upper end of the casing string, or other well conducts to be moved longitudinally with respect to one another without relative rotation, which may be so adjusted without the need for pup joints, slip type hangers, or specially constructed hangers of the type above described.

More particularly, it is an object of this invention to provide such apparatus including a sub which is particularly well suited for use in a well bore in that it requires substantially no more radial space than would a direct threaded connection between the ends of the conduits, but which is capable of transmitting substantially the same axial load when, for example, the string is placed in tension.

These and other objects are accomplished, in accordance with the illustrated embodiment of the present invention, by apparatus including a first tubular member connectable to a first conduit, a second tubular member connectable to a second tubular conduit and spaced concentrically of and held against rotation with respect to the first member, and a sleeve disposed within the space and having first and second threads engaged with threads on the first and second members, respectively, the threads on the sleeve being so related to one another that rotation of the sleeve causes the members, and thus the conduits, to be moved longitudinally with respect to one another, and the sleeve having means thereon to which a tool within the sub may be connected for imparting rotation thereto in order to so adjust the sub. More particularly, the sleeve is relatively thin so as to minimize the thickness of the sub, but has threads which remain engaged with longitudinally overlapping threads on the tubular members, during adjustment of the sub, so as to transmit axial loading between the members which is essentially in shear.

In the preferred and illustrated embodiment of the invention, the means to which a tool may be connected is disposed on a portion of the sleeve which extends out of the space and beyond the end of one of the members, thus making it unnecessary to cut openings or windows in one of the members. Also, the means to which the tool may be connected is disposed on a inner surface of the sleeve for engagement by a tool which is removably disposable inside of the sub, thus permitting unobstructed flow through the sub when the tool is removed following adjustment.

Preferably, the threads are of opposite hand and of essentially the same lead, thus enabling the maximum amount of longitudinal adjustment for a given amount of rotation of the sleeve. However, the threads may be of other construction, including the same hand but of different leads, or even different hand as well as different leads.

In an installation for drilling and/or completing an offshore well of the type above described, the conduit to which one of the tubular members is connectable comprises a hanger body having a shoulder adapted to land on a seat in a casing head on the platform at the ocean surface, and the other conduit to which the second tubular member is connected comprises a casing string which is anchored at its lower end to a mudline hanger within a well bore at the ocean floor. Thus, in drilling and/or completing a subsea well with such apparatus, the hanger body is initially disposed within the head with a shoulder thereabout above the seat, and, upon lowering of the tool through the head and hanger body to engage the sleeve, the tool is rotated in order to rotate the sleeve and thus lower the hanger body to land its shoulder on the seat and place the string in tension.

The means on the sleeve which is to be rotatably engaged by the tool is preferably recessed with respect to the bore of the tubular member through which the tool is lowered, whereby, the inside diameter of the tubular member need not be enlarged, thereby decreasing its wall thickness, in order to permit passage therethrough of a rotatable engagement part on the tool. This would require either reducing the thickness of the tubular member of the sub, or increasing the outside diameter of the tubular member, neither of which are practical alternatives in the case of a well tool of this type. It is a further object of this invention to provide a tool for so rotating the sleeve of this or a similar well tool which is of such construction that it does not require the bore of the tubular member of the sub through which it passes, as it is moved into engagement with the sleeve, to have either an inside or an outside diameter which is enlarged.

This further object is accomplished, in accordance with another novel aspect of the present invention, by apparatus of the type wherein the tool comprises a body which includes longitudinally spaced keys each having an engaging part thereon and carried on the body for rotation therewith and independent radial movement with respect to one another between first positions in which the engaging part is free to slide longitudinally along the cylindrical bore of the member and second positions in which the engaging part rotatably engages the recessed engaging part of the sleeve. More particularly, means are provided for yieldably urging the keys toward their second positions and for anchoring the body of the tool longitudinally with respect to the tubular member, while permitting the tool body to be so rotated, whereby, upon rotation of the body to rotate the sleeve, the engaging part on the sleeve moves successively into engagement with engaging parts on successive keys.

In the preferred and illustrated embodiment of the invention, a groove is formed about the bore of the other tubular member, and a normally retracted, circumferentially split locking means is carried about the tool body and normally contracted into a position in which it may be moved through the bore of the other tubular member into a position opposite the groove, and means carried by the tool body is responsive to well pressure within the tool body to urge the locking means against the bore, after the locking means is lowered past the groove, and then into the bore when the tool body is raised. More particularly, there is a surface on the tool body for engaging the inner side of the locking means to hold it in expanded position upon further upward movement of the tool body, whereby fluid pressure within the tool body may be relieved.

U.S. Pat. No. 4,757,860 shows wellhead members having an annular space between them which is closed off by a seal assembly adapted to form a metal-to-metal seal with the oppositely facing surfaces of the members. More particularly, the seal assembly is lowered into the space on a running tool and includes an annular metal body having an inner conical wall whose inner side fits closely about an outer conical surface of the inner member, and vertically spaced legs which surround the outer side of the wall with a first leg extending upwardly and a second leg extending downwardly therefrom, the outer ends of both legs tightly engaging the inner cylindrical surface of the outer member. Preferably, the seal assembly also includes resilient seal means about the outer side of the inner wall for sealably engaging between said wall and the outer cylindrical surface of the outer member, as well as resilient seal means about the inner wall for sealably engaging the inner conical surface of the inner member. Copending application, Ser. No. 07/370,234, filed June 21, 1989, now abandoned, and entitled "Wellhead Equipment", and assigned to the assignee of the present application, shows other wellhead installations in which the seal assembly is wedged into the space between the oppositely facing, cylindrical and conical surfaces of the wellhead by means other than a running tool.

Although such seal assemblies are particularly well suited for use in an environment in which well fluids are to be contained, they are particularly unsuited for use in closing off an annular space between parallel, straight cylindrical surfaces formed on tubular members which are longitudinally movable relative to one another, such as those of the sub above described. Thus, in such an environment, relative longitudinal movement of the members would either tighten or lessen the sealing effect on the assembly. Although U.S. Pat. No. 4,719,971 shows a somewhat similar seal assembly for closing off an annular space between oppositely facing, straight parallel surfaces of wellhead members, it has legs on both its inner and outer sides for sealable engagement with such surfaces. Also, the inner and outer members with which it is sealed are essentially fixed against relatively longitudinal movement.

Hence, it is a further object of this invention to provide apparatus including a sub or other well tool of the type described in which the annular space between parallel, straight cylindrical surfaces of the inner and outer members is closed by a seal assembly embodying the improved construction of that shown in U.S. Pat. No. 4,757,860, but which avoids substantial changes in loading during relative longitudinal movement of the members.

This and other objects are accomplished in accordance with a further novel aspect of the present invention, by a sub whose inner tubular member has a conical surface at one end of an outer cylindrical surface over which the inner side of an inner wall of the seal assembly is slidable in order to circumferentially expand the assembly, and thus cause the outer ends of the legs to tightly engage the inner surface of the outer member, when the seal assembly is disposed in the space, during assembly of the sub, and which has means on one of the members engagable with opposite ends of the seal assembly to limit its movement with respect to the one member during relative reciprocation of the members.

In the drawings, wherein like reference characters are used to indicate like parts:

Figure 12:
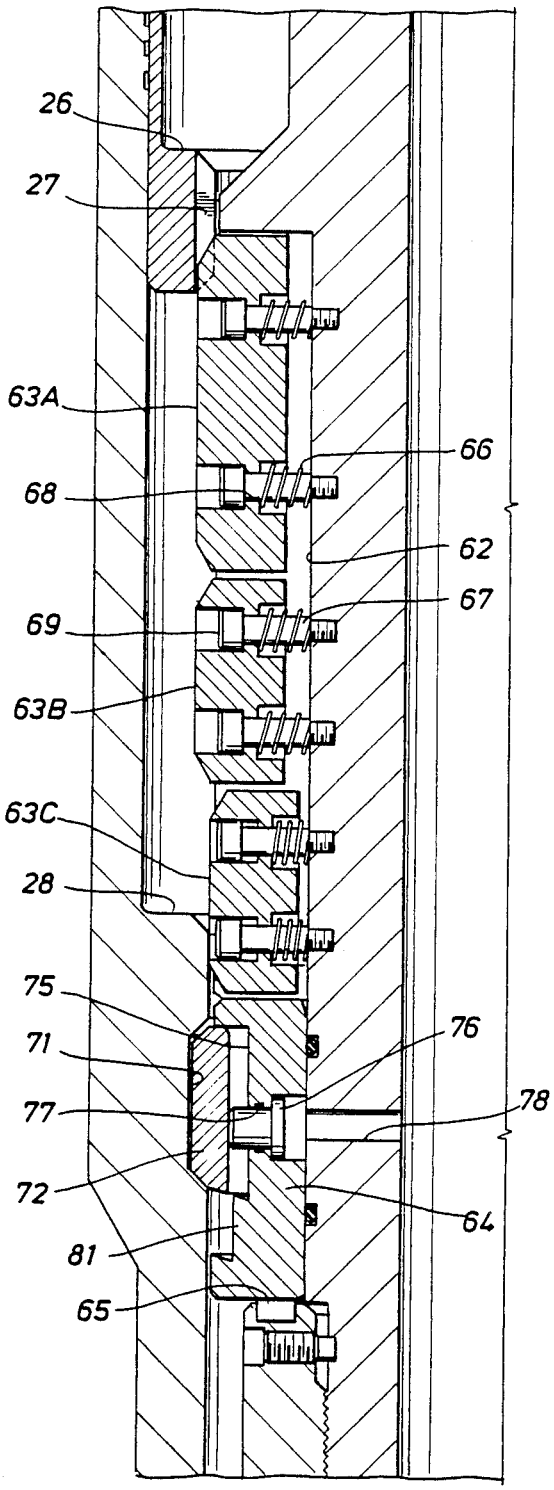
FIG. 12 is a view similar to FIG. 11, but following lowering of the tool to dispose its locking ring beneath a locking groove in the bore of the sub and application of fluid pressure within the tool to urge the locking ring outwardly, and subsequent raising of the tool to permit the locking ring to be moved into the groove.
Figure 13:
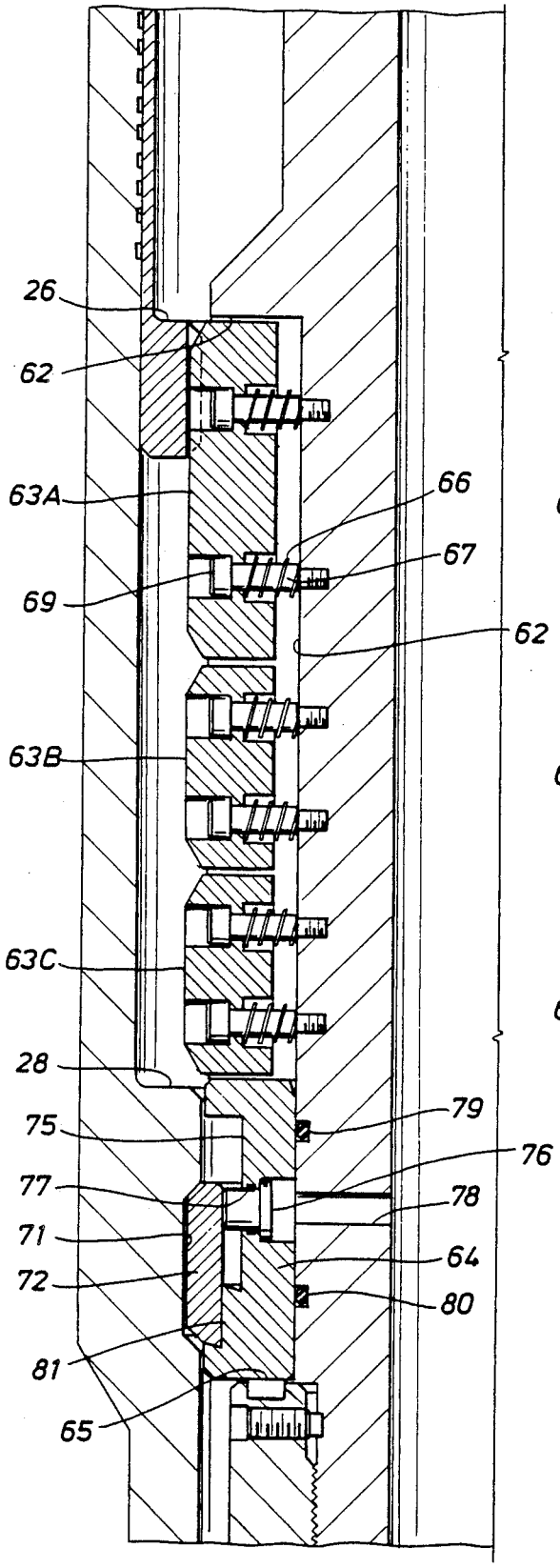
Figure 14:
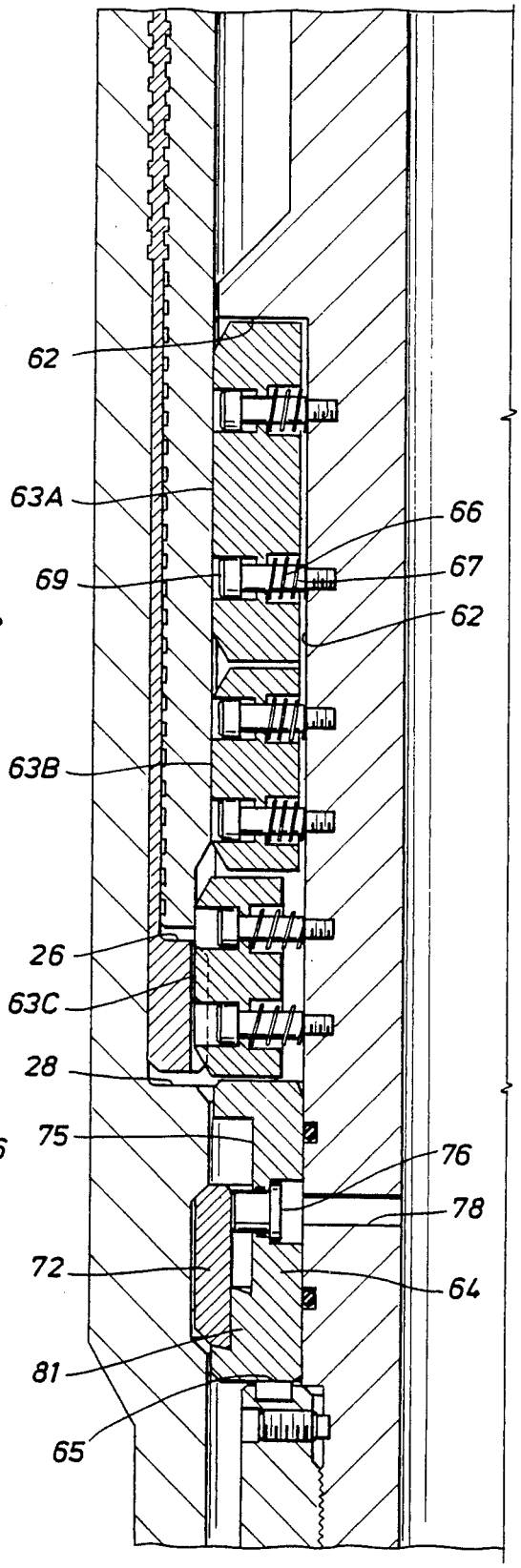

FIG. 13 is a view similar to FIG. 12, but in which the tool has been raised to move a cylindrical holding surface into position within the locking ring to hold it in locking position; and FIG. 14 is a view similar to FIG. 13, but upon rotation of the tool to rotate and thus lower the sleeve as the sleeve is lowered into engagement with successive keys of the tool in order to move the sub to its retracted position.

Figure 1:
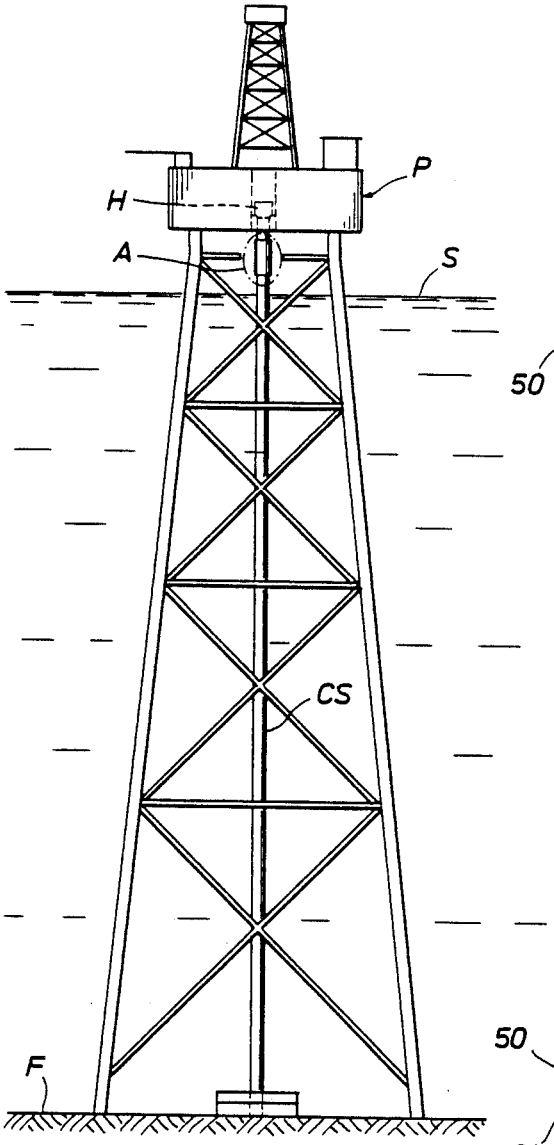
FIG. 1 is an elevational view of an offshore well installation including a platform at the surface of the ocean and a pipe string connected to a hanger body supported from a wellhead at platform and anchored at its lower end to the ocean floor.
Figure 4:
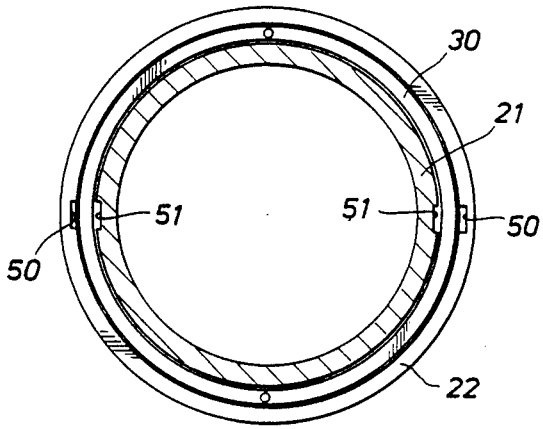
FIG. 4 is a cross-sectional view of the sub as seen along broken lines 4—4 of FIG. 2.
Figure 5:
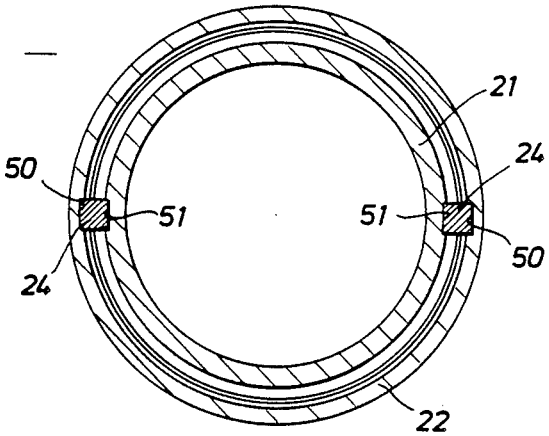
FIG. 5 is a cross-sectional view of the sub, as seen along broken lines 5—5 of FIG. 2.

Referring now to the details of the above described drawings, the platform P is shown in FIG. 1 to be supported at the surface S of the water by means of legs extending downwardly to the ocean floor F. A casing string CS extends between the platform and the ocean floor with its lower end anchored to a mudline hanger (not shown) within the well bore at the floor, and its upper end supported from a casing head mounted on the platform. A sub constructed in accordance with the present invention, and located at the area A of FIG. 1, connects the upper end of the string to a hanger body H which has a shoulder landed on a seat within the wellhead to support the casing string therefrom. More particularly, and as will be described, during the drilling and/or production of the well, the sub has been adjusted from an extended position in which the hanger body is disposed with a shoulder above the seat to a retracted position in which the shoulder is landed on the seat to support the string and place in tension.

Figure 2:
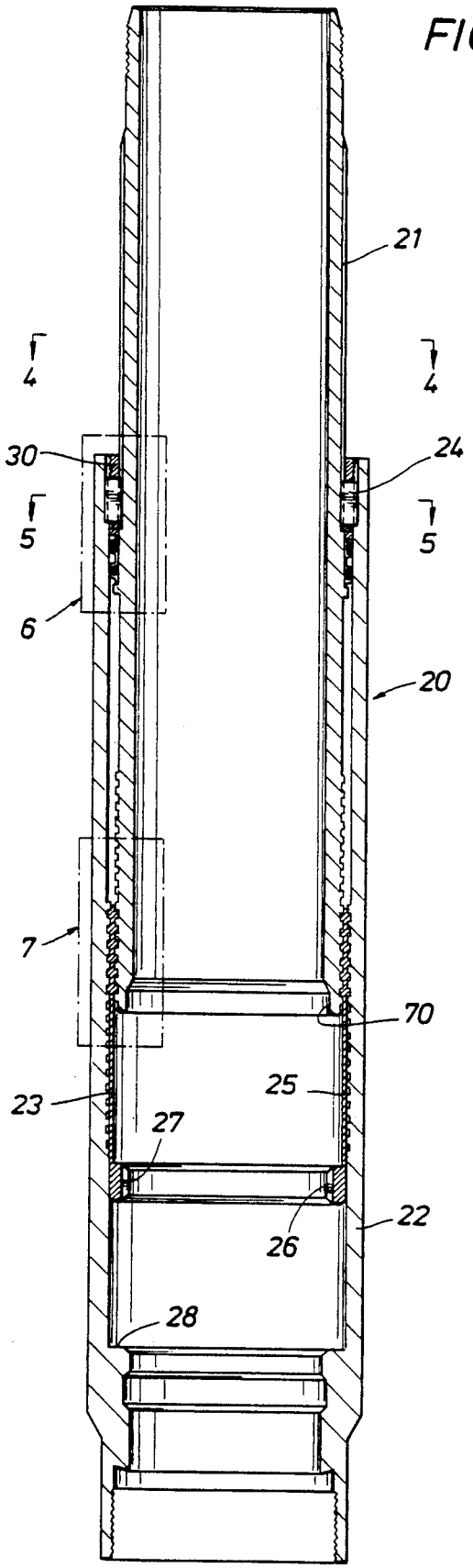
FIG. 2 is a vertical cross-section of a sub constructed in accordance with the present invention, and with the members thereof shown in their longitudinally extended positions.
Figure 3:
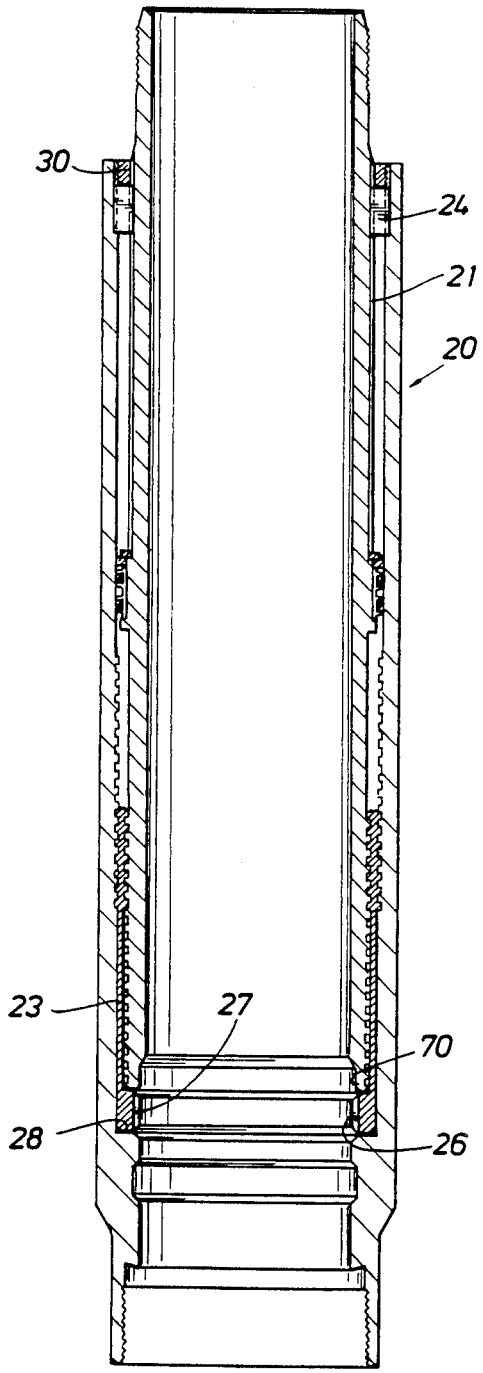
FIG. 3 is a view of the sub similar to FIG. 2, but with the members in longitudinally retracted positions.

The sub, which is indicated in its entirety by the reference character 20 in each of FIGS. 2 and 3, comprises a first tubular member 21 having threads at its upper end for connection to the lower end of the hanger body, which may be of conventional mandrel type construction, and a second tubular member 22 having an upper end spaced concentrically about the lower end of the first member 21. More particularly, the sub also includes a sleeve 23 which is disposed within the space between the tubular members and which has threads on its inner and outer sides engaged with threads on the first and second tubular members, respectively. More particularly, the tubular members are held against rotation with respect to one another by means of lugs 24 fitting within grooves formed o the outer diameter of the inner member and inner diameter of the outer member, and the threads on the inner and outer sides of the sleeve are of opposite hand so that, upon rotation of the sleeve, the members and thus the sub may be moved between the extended and retracted positions of FIGS. 2 and 3, respectively. For example, with the inner threads of left hand and the outer threads of right hand, the sleeve may be rotated in a right-hand direction looking down so as to move the sub from its extended to its retracted position.

Although the threads are preferably of opposite hand, as well as the same lead, so as to provide the maximum longitudinal adjustment per unit of rotation of the sleeve, it is obvious that the inner and outer threads may be otherwise related, as, for example, of the same hand, but of different leads.

The sleeve includes a lower unthreaded portion 25 having a ring on its lower end in which a vertical slot 27 is formed to provide a rotatable engaging part adapted to be rotatably engaged with an adjusting tool lowered into the sub, as will be described. As previously described, and as will be also discussed in detail to follow, the slot is radially recessed with respect to the bores of the tubular members.

In the illustrated embodiment of the invention, wherein the tubular members are moved relatively to one another twice the distance of relative movement of the sleeve, the engaging part 27 of the sleeve is disposed generally intermediate the lower end of the inner member 21 and an upwardly facing shoulder 28 about the bore of the second tubular member. The lugs 24 are held down on a shoulder 29 on the inner diameter of the member 22 by means of a nut 30 made up with the outer diameter of the first member, and the members are movable between a fully longitudinally extended position in which a snap ring 45 removably disposable with a groove about the member 21 is engagable with the lower end of the lugs 24, and the lower end of the first tubular member is near the upper end of the ring, all as shown in FIG. 3.

Figure 7:
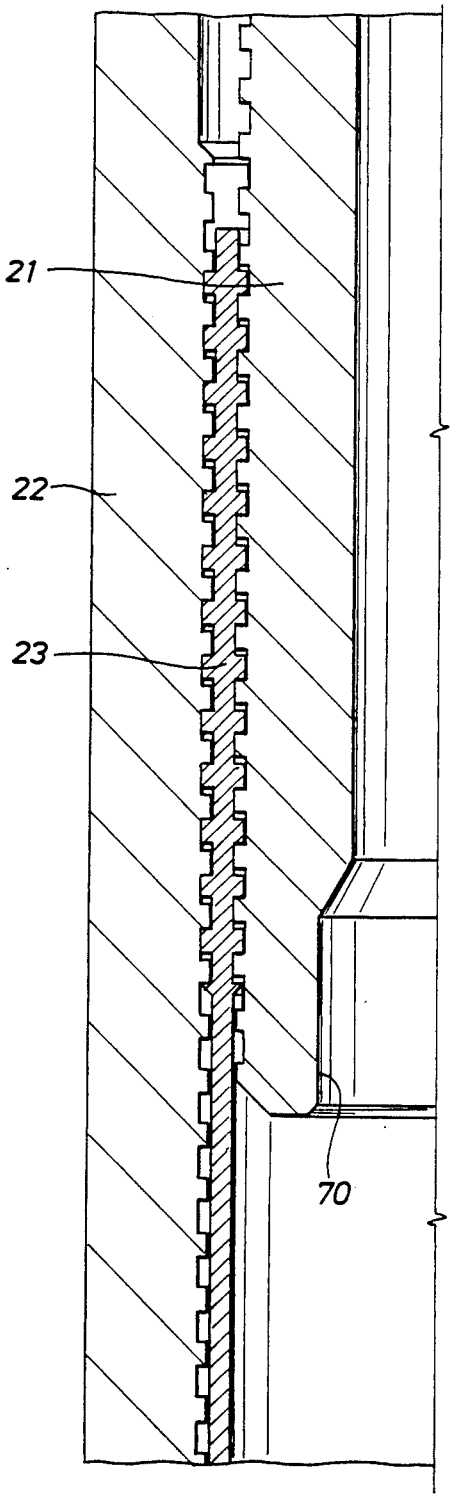
FIG. 7 is an enlarged sectional view of the portion of the sub shown at "7" in FIG. 2.

As shown, and as previously mentioned, the sleeve is relatively thin as compared with the first and second tubular members, such that the sub is of substantially no greater thickness than a conventional sub in which the tubular members are directly threaded to one another. As also previously mentioned, and as will be apparent from the drawings, the threads on the upper end of the sleeve remain threadedly engaged with oppositely disposed threads on the first and second members as the sleeve is moved longitudinally between its extended and retracted positions. As will be further understood from FIG. 7, this insures that the axial load on the sleeve, when the sub is retracted to lower the hanger body onto the seat in the casing head and pull tension on the casing string, is taken essentially in shear across the threads of the sleeve. That is, tensile loading occurs only diagonally across short distance between the upper and lower flanks of each of the square threads.

The annular space between the outer cylindrical surface 32 of the first member 21 and the inner cylindrical surface 33 of the second member 22 is closed by means of a seal assembly which maintains sealing engagement with both cylindrical surfaces during longitudinal adjustment of the sub. As previously described, the seal assembly includes a metal body 34 having an inner wall 35 which, in the sealing position of the assembly, is tightly engaged about the cylindrical surface 32, and legs 36 and 37 which extend outwardly from the outer side of the wall 35 for tightly engaging at their outer ends with the cylindrical wall 33. More particularly, there are two pairs of legs 36 and 37, which are spaced vertically of one another, with each leg 36 of each pair extending downwardly and each leg 37 of each pair extending upwardly. When tightly engaged with the cylindrical wall 33, the legs are flexed respectively downwardly and upwardly so as to maintain sealing engagement therewith a the inner side of the wall 35 seals with respect to wall 32.

Figure 6:
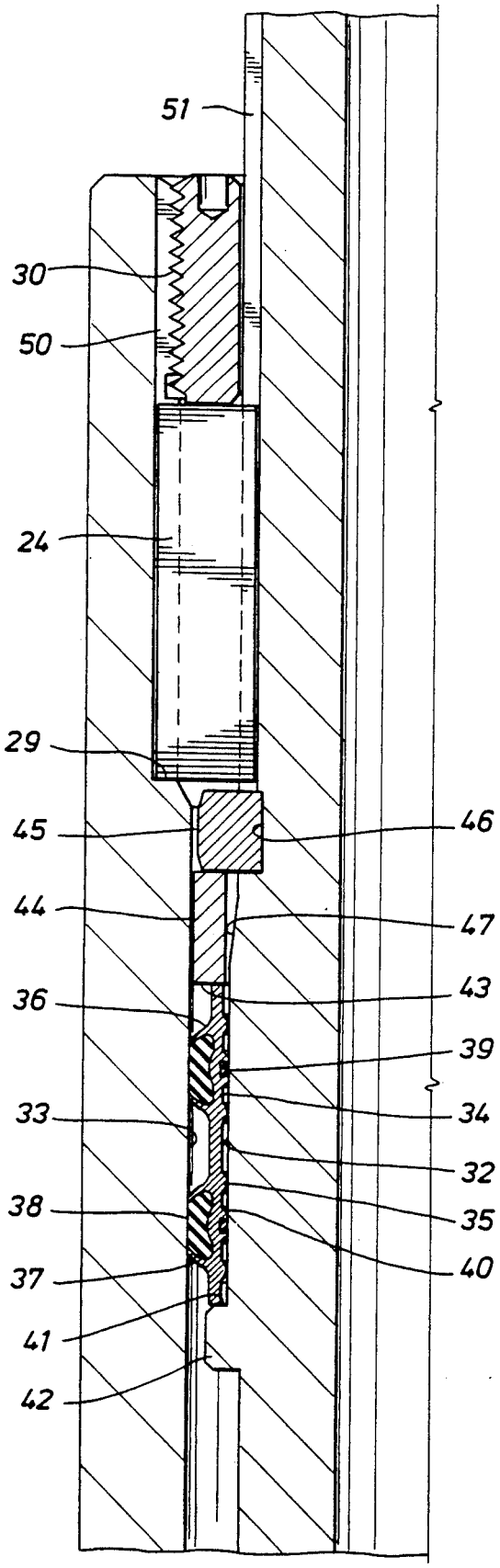
FIG. 6 is an enlarged, partial cross-section view of a portion of the extended sub which is indicated at "6" of FIG. 2.

A ring 38 of rubber or other resilient material is disposed about the outer side of the inner wall of the seal assembly intermediate each pair of downwardly and upwardly extending legs. As described in the aforementioned U.S. Pat. No. 4,757,860, flexing of each pair of the legs will cause the rubber to be extruded outwardly into tight sealing engagement with the wall 33 intermediate the sealing engagement of the outer ends of the legs therewith. As also shown in FIG. 6, a seal ring 39 of rubber or other resilient material is carried within a groove formed within a rib 40 about the inner side of the inner wall of the seal assembly generally opposite each seal ring 38.

When installed to close off the space, the seal assembly is held against longitudinal movement with respect to the first member 21 by means of a shoulder 41 on the upper side of a flange 42 about the surface 32 of the first member, and the lower end 43 of a ring 44 which is held down against the upper end of the seal assembly by means of snap ring 45 received within a groove 46 disposed beneath the anti-rotation lugs 24.

A conical surface 47 is formed on the outer side of the first member above the cylindrical surface 32 and generally opposite the hold down ring 44 in the installed position of the seal assembly. During installation of the seal assembly, and with the snap ring 45, anti-rotation lugs 24 and nut 30 removed, the seal assembly may be lowered over the conical surface 47, which causes its inner wall to be flexed outwardly and thus to cause its inner side to sealably engage the cylindrical surface 32 of the first member. With the seal assembly resting upon the shoulder 41, and ring 44 supported on its upper end, the first member is raised with respect to the second member to permit the snap ring 45 to be installed within groove 46. The first member may then be lowered, and the anti-rotation lugs 24 lowered onto the shoulder 29 upon alignment of grooves 50 and 51 of the inner and outer members, following which the nut 30 may be made up with the upper end of the second member so as to hold the lugs 24 downwardly against the shoulder 29. As shown, the threads on the second member with which the nut engage are slotted to permit the anti-rotation lugs to be moved into place.

Figure 8:
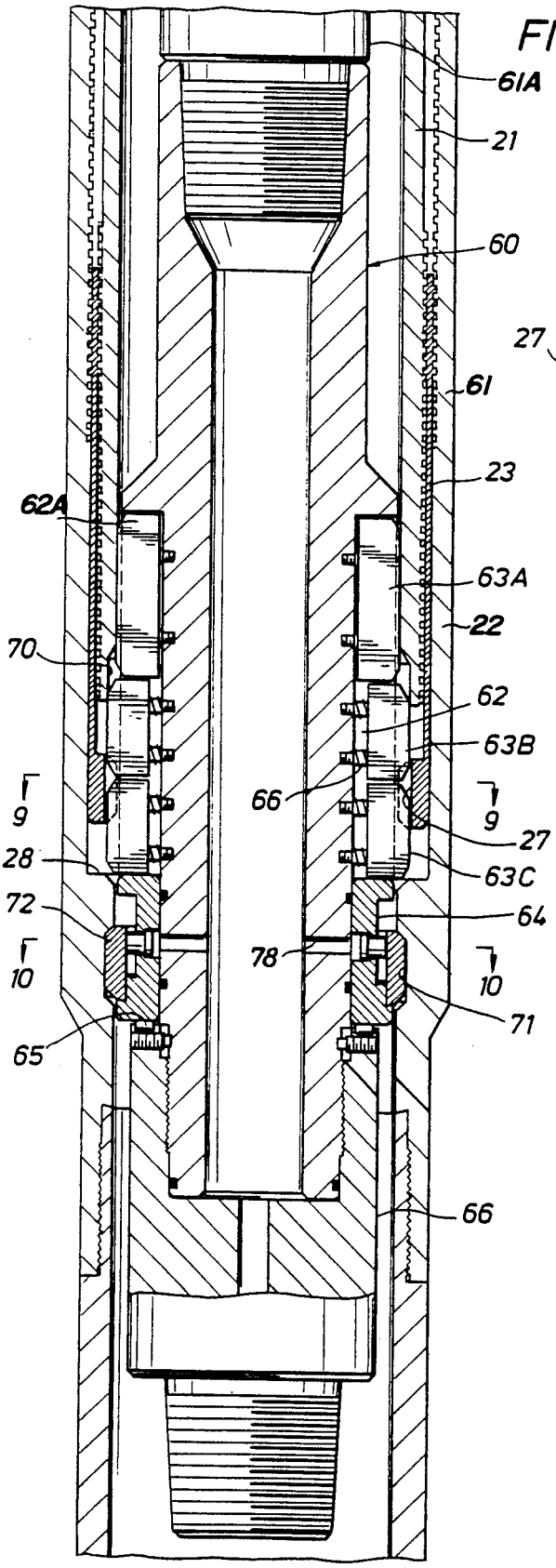
FIG. 8 is a vertical sectional view of the sub with a tool lowered into it and rotatably engaged with the sleeve of the sub to rotate it in a direction to move the sub to it retracted position.
Figure 9:
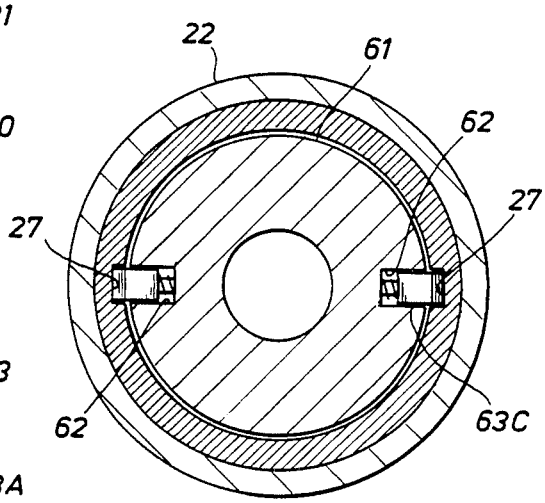
FIG. 9 is a cross-sectional view of the sub and tool, as shown along broken lines 9—9 of FIG. 8.
Figure 10:
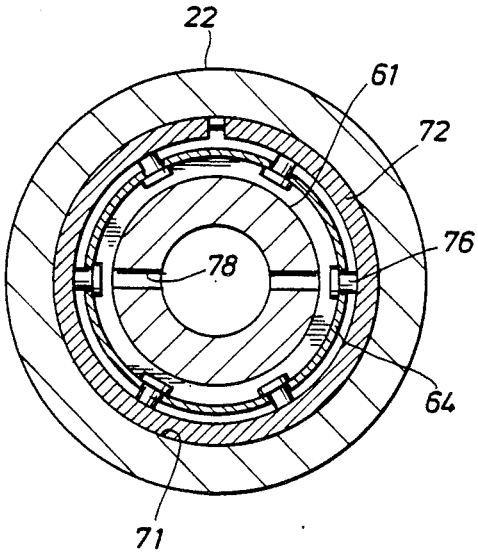
FIG. 10 is a cross-sectional view of the sub and tool, as seen along broken lines 10—10 of FIG. 8.
Figure 11:
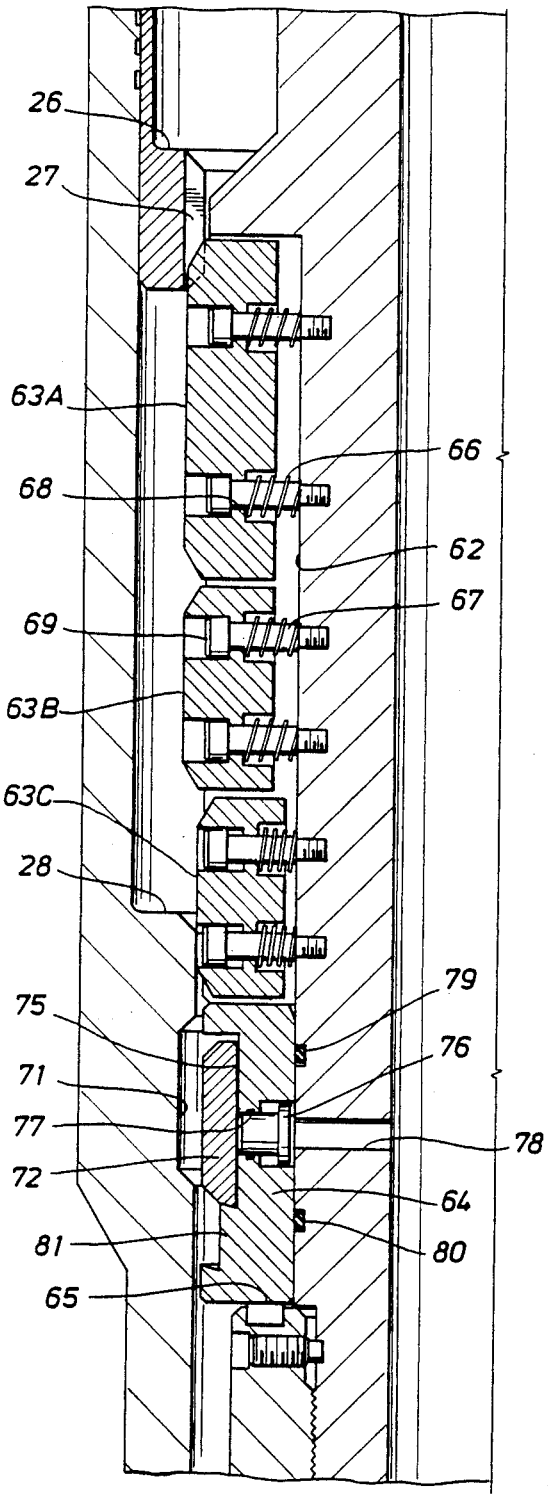
FIG. 11 is an enlarged, partial sectional view of the sub and tool as the tool is initially lowered into a position within the sub to dispose its keys opposite the engaging part on the sleeve of the sub.

The tool for adjusting the effective longitudinal length of the sub, and indicated in its entirety by reference character 60 in FIG. 8, comprises a tubular body 61 connected to the lower end of a running string 61A for lowering into or raising from the sub and, as will be described to follow, passing through the hanger body H to be suspended within the wellhead. The body 61 has vertical slots 62 formed in its opposite sides to receive a series of vertically arranged keys 63A, 63B and 63C for movement within the slot, independently of one another, between radially inner and outer positions. More particularly, the keys are stacked one above the other between the upper end 62A of the slot and the upper end of a ring 64 forming part of the means for anchoring the tool within the sub, which ring is in turn supported on a bearing 65 on the upper end of a lower extension 66 threaded onto the lower end of the tool body.

In the inner positions of the keys, their outer diameters, as well as the outer diameter of the ring 64, permit them to be lowered with the tool body through the cylindrical bores of the tubular members 21 and 22, as shown in FIGS. 11 to 14. Each of the keys 63A, 63B and 63C is of a width for fitting closely within the grooves 27 formed on the inner ends of the rings 26 on the lower end of the sleeve when that key is opposite to the ring, whereby the keys impart rotation of the tool body to the sleeve.

Each of the keys is urged to its outer position, independently of the other keys, by means of coil springs 66 acting between the inner sides of the keys and the inner ends of the slots 62 in which the keys are disposed. Thus, as shown in FIGS. 11 to 14, each such spring surrounds a bolt 67 which is threaded into the tool body at the inner end of each slot and which extends through holes 68 formed in the key to support the keys in vertically spaced relation. The outer enlarged end 69 of each pin thus limits outward of the keys.

The lower end of the first member 21 has a radially enlarged bore 70 of substantially the same diameter as the inner end of the slot 27 in the key on the lower end of the sleeve. This enlarged bore extends upwardly only a short distance from the lower end of the first member, so that, as the tool is first lowered into the sub, the keys slide downwardly along the bore of the first member, above the enlarged bore 70, so as to hold them in their inner positions. However, as the sub is retracted to the position of FIG. 8, the entire height of each key is free to move outwardly into the slot 27. The outer ends of the keys are tapered at their upper and lower ends to permit them to move freely into and out of the slots 27, as well as back into the bore above enlarged bore 70 as the sub is extended.

As the tool is lowered into the sub for the purpose of adjusting its length, the tool body is rotated until the keys are rotatably engaged with the slots 27 in the lower end of the sleeve. As previously described, a means is provided for anchoring the tool body within the second tubular member when at least one of the keys is engaged with the slots in the lower end of the ring of the sleeve, so that, with the tool body so anchored, the tool may be rotated to impart rotation to the sleeve. Thus, the sleeve is of such length that when the sub is in its fully extended position, as shown in FIG. 1, and the tool body is anchored to the second member, the slots 27 in the sleeve are rotatably engaged with the uppermost key 63A.

Then, as the sleeve is rotated by means of the tool, and thus moves downwardly with respect to the second member, and thus the tool, its slots 27 are moved into rotative engagement with successive keys, so that, in the fully retracted position of the sub, the slots are rotatably engaged with the lowermost keys 63C, as shown in FIG. 14. As previously mentioned, the enlarged bore 70 insures that the lowermost key is free to move fully outwardly to its outer engaging position. The upper end of this enlarged bore 70 is conically tapered to facilitate retraction of the lowermost key 63 to its inner position as the tool is raised from within the sub.

The tool body is anchored with respect to the second member by means which includes a groove 71 formed in the bore of the second member beneath the shoulder 28, and a circumferentially split locking ring 72 which is normally retracted to permit it to be lowered through the bore of the first member, along with the keys, but which is adapted to be expanded outwardly into the groove, as shown in FIGS. 12, 13 and 14. Thus, the split ring 72 is carried within a groove 75 about the outer diameter of the ring 64 which has an upper cylindrical portion in which the normally contracted split ring 72 is disposed with its outer diameter in general alignment with the outer diameter of the retracted keys in their inner position.

The ring 72 is adapted to be urged outwardly into the groove 71, when disposed opposite thereto, by means of a plurality of pins 76 sealably slidable within holes 77 in ring 64 which connect with the groove 75 generally opposite the split ring 72. More particularly, one or more ports 78 are formed in the tool body to connect the bore of the tool body with the inner diameter of the ring intermediate upper and lower seal rings 79 and 80 within grooves about the outer diameter of the tool body, whereby pressure may be transmitted through the bore of the tool body and into the enlarged outer ends of the holes in which the pins are reciprocal to urge the pins outwardly and thus force the normally contracted split ring 72 outwardly into the groove 71 when opposite thereto.

In order to anchor the tool to the second member, it is first lowered to a position in which the normally contracted seal ring 72 moves downwardly into the bore of the second tubular member below the groove 71. During this time, the keys will be successively urged inwardly to their inner positions as they move into the bore of the second member above and below the groove 71. With the tool lowered to this position, pressure fluid is transmitted through the tool to urge the split ring 72 outwardly against the bore, so that, as the tool body is raised to the position shown in FIG. 12, this pressure acts on the pins 76 to force them outwardly to move the ring 72 into the groove 71.

The groove 75 includes an enlarged diameter portion beneath the reduced portion thereof which fits within the inner diameter of the expanded locking ring 72 as the tool body is raised from the position of FIG. 12 to the position of FIG. 13. At this time then, the fluid pressure in the tool may be relieved since the lock ring is otherwise held in its expanded locking position. More particularly, a strain may then be taken on the tool body so as to pull the upper end of the ring 72 against the upper end of the groove 71 as the tool is rotated to adjust the sub.

When the sub has been adjusted, and it is desired to remove the tool so as to open up the sub to flow therethrough, the tool body need only be lowered a short distance to dispose the smaller diameter portion of groove 75 opposite the locking ring 72. This frees the locking ring 72 to move inwardly, and thereby permit it to be raised past the bore of the second member above the groove 71 and out of the sub with the remainder of the tool. During this time, of course, the keys are successively moved out of engagement with the locking parts 27 on the lower end of the sleeve and compressed to their inner positions as they pass upwardly through the bore in the first tubular member. During assembly of the tool, the extension 66 may be removed from the lower end of the tool body to permit the keys to be moved upwardly into the open ends of the slots 62 and then mounted on the tool body by means of the pins. The ring 64 with the locking ring 72 contracted carried with the groove therein may then be assembled over the lower end of the tool body, and the extension 66 threaded on to the lower end of the upper body and held in place by the set screws shown in FIGS. 11 to 14.

In the drilling or completion of a well, the sub is connected between the casing hanger body and the upper end of the casing string CS and at least to some extent, so as to locate the hanger body within the casing head with its shoulder above the seat in the casing head. At this time, the tool may be lowered through the hanger body and into the sub to a position in which its locking ring 72 moves downwardly into the bore of the second member beneath the groove 71, and pressure fluid may be transmitted through the tool so as to urge the locking ring 72 outwardly, such that raising of the tool body will cause the locking ring to be automatically forced outwardly into the groove 71. At this time, the tool body is then raised further to move the ring 64 into a holding position at which time the pressure may be relieved and, as shown in the drawings, the slots 27 in the lower end of the sleeve will be on generally the same level as at least one of the keys, depending on the extent to which the sub is extended.

The tool may then be rotated so as to in turn rotate the sleeve in the direction necessary to retract the sub and thus lower the first member of the sub and the hanger body to which it is connected so as to land the shoulder of the hanger body on the seat in the casing head and then place the casing string in tension by continued rotation of the tool. Following this step, of course, the tool may be manipulated so as to release the locking ring from its anchoring location and then raised from the sub.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A longitudinally adjustable sub for connecting tubular well conduits, comprising a first tubular member connectable to a first conduit, a second tubular member connectable to a second conduit and being spaced concentrically of the first tubular member, and a sleeve disposed within the space and having first and second threads engaged with threads on the first and second tubular members, respectively, and so related to one another that rotation of the sleeve causes the tubular members to move longitudinally with respect to one another, the sleeve having means thereon to which a tool removably disposable within the sub may be connected for imparting rotation thereto in order to adjust the sub, and the threads on the sleeve remaining engaged with longitudinally overlapping threads on the tubular members so as to transmit axial loading between said members essentially in shear.

2. A sub of the character defined in claim 1, including means holding said tubular members against relative rotation.

3. A sub of the character defined in claim 1, wherein the means to which a tool may be connected is disposed on a portion of the sleeve which extends out of the space and beyond the end of one of the members.

4. A sub of the character defined in claim 1, wherein the means to which a tool may be connected is disposed on an inner surface of the sleeve.

5. A sub of the character defined in claim 3, wherein the means to which a tool may be connected is disposed on an inner surface of the sleeve.

6. A sub of the character defined in claim 1, wherein the threads are of opposite hand.

7. A sub of the character defined in claim 6, wherein the threads are of essentially the same lead.

8. Well apparatus for use in longitudinally extending or retracting well conduits, comprising a sub having a first tubular member connectable to a first conduit, a second tubular member connectable to a second conduit being spaced concentrically of the first member, and a sleeve disposed within the space and having first and second threads engaged with threads on the first and second members, respectively, and so related with respect to one another that rotation of the sleeve causes the tubular members to move longitudinally with respect to one another, and a tool removably disposable within the sub and having means thereon for engaging with means on the sleeve for imparting rotation to the sleeve, the threads on the sleeve remaining engaged with longitudinally overlapping threads on the tubular members so as to transmit axial loading between said members essentially in shear.

9. Well apparatus of the character defined in claim 8, including means holding said tubular members against relative rotation.

10. Well apparatus of the character defined in claim 8, wherein the means to which the tool may be connected is disposed on a portion of the sleeve which extends out of the space and beyond the end of one of the members.

11. Well apparatus of the character defined in claim 8, wherein the means to which the tool may be connected is disposed on an inner surface of the sleeve for engagement by the tool as the tool is moved longitudinally into the sub.

12. Well apparatus of the character defined in claim 10, wherein the means to which the tool may be connected is disposed on an inner surface of the sleeve for engagement by the tool as the tool is moved longitudinally into the sub.

13. Well apparatus of the character defined in claim 8, wherein the threads are of opposite hand.

14. Well apparatus of the character defined in claim 13, wherein the threads are of essentially the same lead.

15. Well apparatus of the character defined in claim 8, wherein the engaging means on the sleeve comprises an engaging part radially recessed with respect to a cylindrical surface of one of the members, the tool comprises a body movable longitudinally into a position opposite the cylindrical surface of the one member, and the engaging means on the tool comprises longitudinally spaced keys each having an engaging part thereon and carried by the body of the tool for rotation therewith and independent radial movement with respect to one another between first positions in which the engaging parts are free to slide longitudinally along the cylindrical surface of the one member and second positions in the engaging parts rotatably engage the engaging part on the sleeve, means yieldably urging the keys toward their second positions, and means for anchoring the body of the tool longitudinally with respect to the other member while permitting the body to be rotated, so that, upon rotation of said body to rotate the sleeve, the engaging part on the sleeve is successively moved into engagement with engaging parts on successive keys.

16. Well apparatus of the character defined in claim 15, wherein the anchoring means comprises a groove about the other tubular member, a ring carried about the tool body for rotation with respect thereto and circumferentially split normally retracted locking means carried within a groove about the ring for disposal opposite the groove, and means carried by the ring which is responsive to well pressure transmitted through the tool body to expand the locking means into the groove in the other tubular member, after the locking means is lowered past the groove, whereby the locking means is automatically forced out into the groove as the tool body is raised.

17. Well apparatus of the character defined in claim 16, wherein the groove in the ring has a surface for holding the locking means expanded upon further upward movement of the body, whereby fluid pressure may be relieved.

18. For use in drilling and/or completing an offshore well wherein a pipe string is to be suspended from a seat within a casing head on a platform at the water surface above a mudline hanger within a well bore at the ocean floor to which the lower end of the string is connected, apparatus comprising a hanger body having a shoulder adapted to be landed on the seat, a sub including a first tubular member adapted to be connected to the lower end of the hanger body, a second tubular member adapted to be connected to the upper end of the string and being spaced concentrically of the lower end of the first member, and a sleeve disposed within the space and having first and second threads connected to the first and second members, respectively, and so related with respect to one another that rotation of the sleeve causes the tubular members to move longitudinally with respect to one another from a first position in which the hanger body shoulder is above the seat to a second position in which the shoulder is landed on the seat and the string is placed in tension, and a tool lowerable through the hanger body and into the sub for so rotating the sleeve, the threads on the sleeve remaining engaged with longitudinally overlapping threads on the tubular members so as to transmit axial loading between said members essentially in shear.

19. In a method of drilling and/or completing a subsea well, wherein a pipe string anchored at its lower end to a mudline hanger within a well bore at the ocean floor is to be suspended in tension from a seat within a casing head on a platform at the water surface, the steps of connecting the upper end of the pipe string to a hanger body by means of longitudinally retractable sub to support a shoulder about the hanger body above the seat in the head, said sub comprising a first tubular member connected to the hanger body, a second tubular member connected to the upper end of the string and spaced concentrically of the lower end of the first member, a sleeve disposed within the space and having first and second threads connected to the first and second members, respectively, and so related with respect to one another that rotation of the sleeve causes the tubular members to move longitudinally with respect to one another, and lowering a tool through the head and hanger body to engage and rotate the sleeve in order to retract the sub and thereby lower the hanger body to land its shoulder on the seat and place the string in tension, the threads on the sleeve remaining engaged with longitudinally overlapping threads on the tubular members so as to transmit axial loading between said members which is essentially in shear.

20. A well tool, comprising first and second tubular members adapted to be connected in a pipe string for longitudinal movement with respect to one another, and a seal assembly for sealing between concentrically spaced, radially outer and inner parallel, cylindrical surfaces on the first and second members, respectively, so as to close the space, including an annular metal body having an inner wall and vertically spaced legs surrounding the outer side of the inner wall with a first leg extending upwardly and a second leg extending downwardly therefrom, said first member having a conical surface at one end of its outer cylindrical surface over which the inner side of the inner wall of the seal assembly may slide in order to circumferentially expand the assembly, and the outer ends of both legs tightly engaging the inner surface of the second member for sealing with respect thereto when the seal assembly is disposed within the space, and, means on the first member engagable with opposite ends of the seal assembly to limit its longitudinal movement with respect to the first member during relative longitudinal movement of the members.

21. A tool of the character defined in claim 20, including resilient seal means about the outer side of the inner wall above the first leg and below the second leg and sealably engaging between said wall and the inner cylindrical surface of the second member.

22. A tool of the character defined in claim 20, including resilient seal means about the inner side of the outer wall and sealably engaging the inner cylindrical surface of the first member.

23. A tool of the character defined in claim 21, wherein the second leg is above the first leg, and the resilient seal means comprises a seal ring confined within a recess between the legs.

24. A tool for longitudinally adjusting a sub which includes a first tubular member connected to a first conduit, a second tubular member connected to a second conduit and being spaced concentrically of the first tubular member, and a sleeve disposed within the space and having first and second threads engaged with threads on the first and second tubular members, respectively, and so related to one another that rotation of the sleeve causes the tubular members to move longitudinally with respect to one another, said tool comprising a body adapted to be lowered into the sub and having longitudinally spaced keys each having an engaging part thereon and carried by the tool body for rotation therewith and independent radial movement with respect to one another between first positions in which the engaging parts are free to slide longitudinally along the bore of the first member and second positions in the engaging parts thereon rotatably engage the engaging part on the sleeve, means yieldably urging the keys toward their second positions, and means for anchoring the body of the tool longitudinally with respect to one of the members while permitting the body to be rotated, so that, upon rotation of said body to rotate the sleeve, the engaging part on the sleeve is successively moved into engagement with engaging parts on successive keys.

25. A tool of the character defined in claim 24, wherein a groove is formed in the cylindrical bore of the first tubular member and the anchoring means on the tool body includes a ring carried about the tool body for rotation with respect thereto and circumferentially split normally retracted locking means carried within a groove about the ring for disposal opposite the groove in the first tubular member, and means carried by the ring which is responsive to well pressure transmitted through the tool body to expand the locking means into the groove in the first tubular member, after the locking means is lowered past the groove, whereby the locking means may be automatically forced-out into the groove as the tool body is raised.

26. A tool of the character defined in claim 25, wherein the groove in the ring has a surface holding the locking means expanded upon further upward movement of the tool body, whereby fluid pressure may be relieved.

* * * * *